United States Patent [19]

Bares

[11] Patent Number: 4,839,688

[45] Date of Patent: Jun. 13, 1989

[54] DEVELOPMENT APPARATUS

[75] Inventor: Jan Bares, Webster, N.Y.

[73] Assignee: Xerox Corporation, Stamford, Conn.

[21] Appl. No.: 185,593

[22] Filed: Apr. 25, 1988

[51] Int. Cl.[4] ..... G03G 15/08; G03G 15/01

[52] U.S. Cl. ..... 355/253; 355/328; 118/645

[58] Field of Search ..... 355/4, 3 DD, 14 D; 118/653, 657–658, 261

[56] References Cited

U.S. PATENT DOCUMENTS 4,352,552 10/1982 Stange ..... 355/4
4,746,952 5/1988 Kusuda et al. ..... 355/4

FOREIGN PATENT DOCUMENTS 54-6555 1/1979 Japan ..... 355/4
58-169160 10/1983 Japan ..... 355/4

*Primary Examiner*—Arthur T. Grimley
*Assistant Examiner*—J. Pendegrass
*Attorney, Agent, or Firm*—H. Fleischer; J. E. Beck; R. Zibelli

[57] ABSTRACT

An apparatus in which a latent image recorded on a photoconductive member is developed with developer material. A developer roller, positioned closely adjacent to the photoconductive member, is arranged to transport the developer material into contact with the photoconductive surface in the development zone. A blade member moves from an operative position to a non-operative position. In the non-operative position, the blade member has the free end portion thereof spaced from the developer roller. This enables the developer roller to transport the developer material into contact with the photoconductive member to develop the latent image recorded thereon. In the operative position, the blade member has the free end portion thereof contacting the developer roller. This prevents the developer roller from transporting the developer material into contact with the photoconductive member to prevent development of the latent image recorded thereon.

12 Claims, 3 Drawing Sheets

DEVELOPMENT APPARATUS

This invention relates generally to an electrophotographic printing machine, and more particularly concerns energizing and deenergizing selected developer units of the electrophotographic printing machine to produce highlight color copies.

In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner paticles ae attracted from the carrier granules of the developer material onto the latent image. The resultant toner powder image is then transferred from the photoconductive surface to a copy sheet and permanently affixed thereto. The foregoing generally describes a typical black and white electrophotographic copying machine. With the advent of multicolor electrophotographic printing, the process is repeated for three or four cycles. Thus, the charged photoconductive surface is exposed to a filtered light image. The resultant electrostatic latent image is then developed with toner particles corresponding in color to the subtractive primary of the filtered light image. For example, when a red filter is employed, the electrostatic latent image is developed with cyan toner particles. The cyan toner powder image is then transferred to the copy sheet. The foregoing process is repeated for a green filtered light image which is developed with magenta toner particles and a blue filtered light image which is developed with yellow toner particles. Each differently colored toner powdered image is sequentially transferred to the copy sheet in superimposed registration with the powder image previously transferred thereto. In this way, three toner powder images are transferred sequentially to the copy sheet. After the toner powder images have been transferred to the copy sheet, they are permanently fused thereto. Thus, color electrophotographic printing machines previously employed required three passes to produce a multicolor copy. This, of course, reduced the speed of the printing machine. A typical electrophotographic printing machine employing the foregoing process is manufactured by the Xerox Corporation under the model name 1005.

Recently, electrophotographic printing machines have been developed which produce highlight color copies. A typical highlight color printing machine records successive electrostatic latent images on the photoconductive surface. When combined, these electrostatic latent images form a total latent image corresponding to the entire original document being reproduced. One latent image is usually developed with black toner particles. The other latent image is developed with color highlighting toner particles, e.g. red toner particles. These developed toner images are transferred to the copy sheet to form the color highlighted copy. In order to prevent comingling of the different color developer materials, one developer unit must be non-operative when the other developer unit is operative.

It is clear that in a highlight color printing machine, the change of developer units must be completed in a very short time to change colors. Preferably, a developr unit of one color should be deenergized and a developer unit of another color energized during the time between latent images. In electrophotographic printing, there is a space between successive latent images recorded on the photoconductive member. Developer units should be changed in the time required for that space to move through the development zone. For example, in a 30 inch/second printing machine having a 1.5 inch space between adjacent latent images, 50 milliseconds are available to change developer units, i.e. colors. During that time the flow of developer material of one color must be completely stopped and the flow of developer material of the other color developer material must be completely restored. Various techniques may be used for removing developer material from a roller. The following disclosures appear to be relevant:

U.S. Pat. No. 4,396,276
Patentee: Murasaki
Issued: Aug. 2, 1983
U.S. Pat. No. 4,440,488
Patentee: Maekawa et al.
Issued: Apr. 3, 1984
U.S. Pat. No. 4,568,175
Patentee: Inowa et al.
Issued: Feb. 4, 1986
U.S. Pat. No. 4,639,123
Patentee: Adachi et al.
Issued: Jan. 27, 1987

The relevant portions of the foregoing disclosures may be briefly summarized as follows:

U.S. Pat. No. 4,396,276 discloses a copying machine including a blade cleaner. The blade is made from an elastic material on a support plate. The blade is pivotably movable between a position pressing against a photoconductive drum and a position spaced from the photoconductive drum.

U.S. Pat. No. 4,440,488 describes a cleaning device for a photosensitive member. The cleaning device includes an elastic scraper blade and an L-shaped blade holder pivotably supported on the housing of the copying machine.

U.S. Pat. No. 4,568,175 discloses a cleaning device having a blade bearing against a photoconductive drum. The blade is mounted in a rotatable blade holding frame.

U.S. Pat. No. 4,639,123 describes an elastic cleaning member bearing againt a photoconductive drum to remove developer material and dust adhering thereto.

In accordance with one aspect of the present invention, there is provided an apparatus for developing a latent image recorded on a member with developer material. The apparatus includes means, positioned closely adjacent the member defining a development zone therebetween, for transporting the developer material into contact with the member in the development zone so as to develop the latent image recorded thereon with developer material. A blade member is arranged to move from an operative position to a non-operative position. In the operative position, the blade member has the free end portion thereof contacting the transporting means. This prevent the transporting means from transporting developer material into contact with the member preventing development of the latent image recorded thereon. In the non-operative position, the blade member has the free end portion thereof spaced from the transporting means. This enables the transporting means to transport the developer material into contact with the member to develop the latent image recorded thereon.

Pursuant to another aspect of the present invention, there is provided an electrophotographic printing machine in which at least a first latent image and a second latent image recorded on a photoconductive member are developed with different color developer materials. The printing machine includes first means, positioned closely adjacent the photoconductive member defining a first development zone therebetween, for transporting developer material of a first color into contact with the photoconductive member in the first development zone so as to develop the first latent image recorded thereon with the first color developer material. Second means, positioned closely adjacent the photoconductive member defining a second development zone therebetween, transports developer material of a second color into contact with the photoconductive member in the second development zone so as to develop the second latent image recorded thereon with the second color developer material. A first blade member is operatively associated with the first transporting means and arranged to move from an operative position to a non-operative position. In the operative position, the first blade member has the free end portion thereof contacting the first transporting means. In the non-operative position the first blade member has the free end portion thereof spaced from the first transporting means. A second blade member is operatively associated with the second transporting means and arranged to move from an operative position to a non-operative position. In the operative position, the second blade member has the free end portion thereof contacting the second transporting means. In the non-operative position, the second blade member has the free end portion thereof spaced from the second transporting means. The first blade is in the non-operative position when the second blade member is in the operative position. This prevents the second transporting means from transporting second color developer material into contact with the photoconductive member while enabling the first transporting means to transport the first color developer material into contact with the photoconductive member to develop the first latent image recorded thereon with first color developer material. The second blade member is in the non-operative position when the first blade member is in the operative position. This prevents the first transporting means from transporting first color developer material into contact with the photoconductive member while enabling the second transporting means to transport the second color developer material into contact with the photoconductive member to develop the second latent image recorded thereon with second color developer material.

Other features of the present invention will become apparent as the following description proceeds and upon reference to the drawings, in which.

While the present invention will be described in connection with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Figure 1:
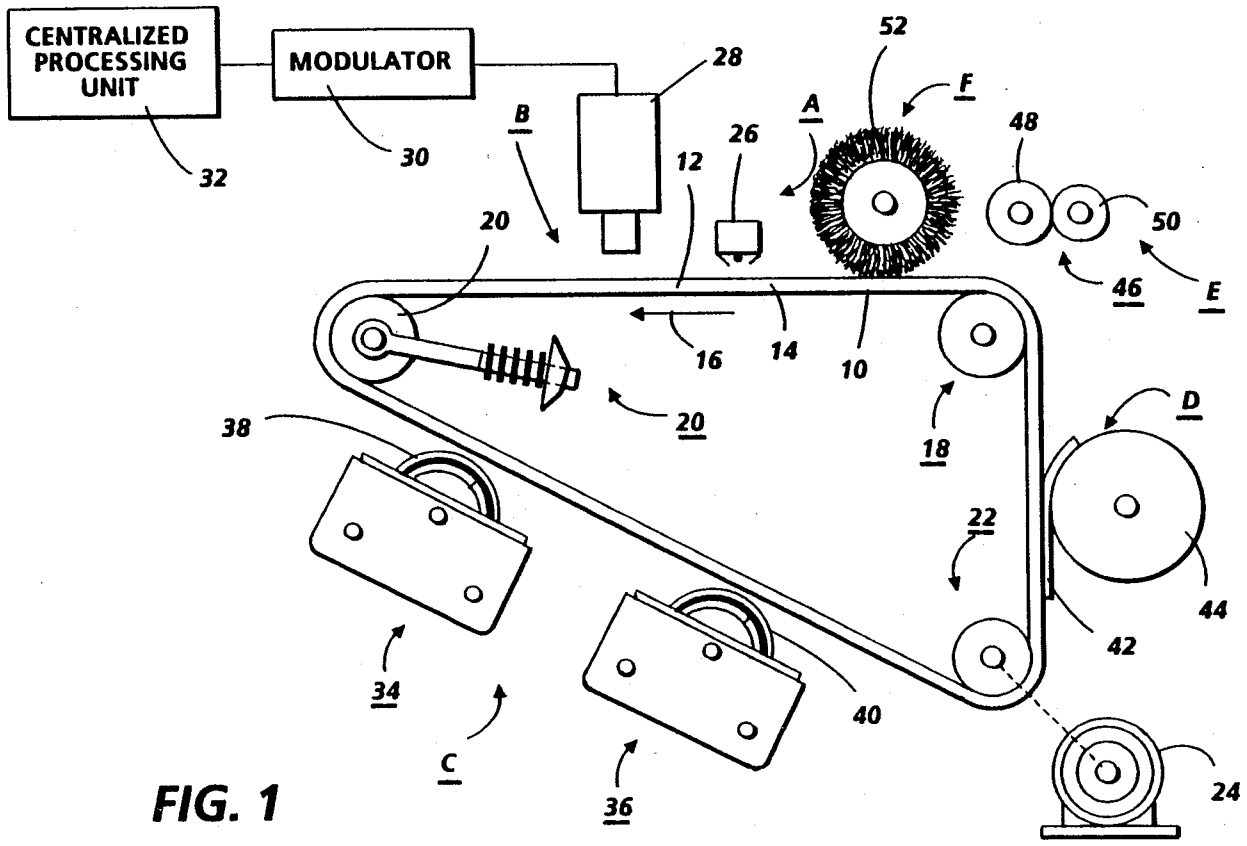
FIG. 1 is a schematic elevational view of an illustrative electrophotographic printing machine incorporating the developer units of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of the electrophotographic printing machine incorporating the developer units of the present invention therein. Although the developer units of the present invention are particularly well adapted for use in the illustrative printing machine, it will become evident that these developer units are equally well suited for use individually or together in a wide variety of electrostatographic printing machines and are not necessarily limited in their application to the particular embodiments shown herein.

Referring now to FIG. 1, the electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs resiliently urging tensioning roller 20 against belt 10 with the desired spring force. Stripping roller 18 and tensioning roller 20 are mounted to rotate freely.

Initially, belt 10 passes through charging station A. At charging station A, a corona generating device, indicated generally by the reference numeral 26 charges photoconductive surface 12 to a relatively high, substantially uniform potential. A high voltage power supply is coupled to corona generating device 26. Excitation of the power supply causes corona generating device 26 to charge photoconductive surface 12 of belt 10. The charged photoconductive surface 12 is next advanced through exposure station B.

At exposure station B, the charged photoconductive surface 12 is selectively exposed by a modulated laser beam from scanning laser unit 28. A modulator 30, coupled to scanning laser unit 28, receives an input from an informational source which, for example, may be a centralized processing unit 32, and modulates the laser beam of the scanning laser 28 to record a first electrostatic latent image on photoconductive surface 12. By way of example, a helium neon laser is suitable for operation in this manner. One skilled in the art will recognize that any suitable scanning laser and modulator unit may be used in this capacity. For example, a suitable scanning laser unit and modulator unit are described in U.S. Pat No. 4,124,286 issued to Barasch on Nov. 7, 1978, the relevant portions thereof being hereby incorporated into the present application. After the first electrostatic latent image is recorded on photoconductive surface 12, the foregoing process is repeated to record a second electrostatic latent image thereon. The first electrostatic latent image is separated from the second electrostatic latent image on photoconductive surface 12 by an interimage space. Thus, there are successive electrostatic latent images containing different information thereon recorded on photoconductive surface 12. The first electrostatic latent image is developed with developer material of one color and the second electrostatic latent image is developed with developer material of another color. Typically, one of the colors is black with the other color being a highlight color, such as red. The differently colored developed images are transferred to a common sheet to form a copy having two colors thereon, i.e. black and red indicia.

Belt 10 advances the latent images to development station C. Development station C includes two developer units indicated generally by the reference numerals 34 and 36, respectively. Developer unit 34 is adapted to develop the first electrostatic latent image with black developer material. Developer unit 36 is adapted to develop the second electrostatic latent image with a highlight color developer material, e.g. a red developer material. When developer unit 34 is operative, developer unit 36 is non-operative. For example, when developer unit 34 is developing the first electrostatic latent image with black developer material, developer unit 36 is non-operative. Conversely, when developer unit 36 is developing the second electrostatic latent image with a highlight color developer material, developer unit 34 is non-operative. Each developer unit includes a magnetic brush developer roller 38 and 40, respectively. Each roller, when operative, advances developer material into contact with the latent image. These developer rollers form a brush of carrier granules and toner particles extending outwardly therefrom. The latent image attracts toner particles from the carrier granules forming a toner powder image thereon. Developer units 34 and 36 are identical to one another, the only difference being the color of the toner particles contained therein. Developer unit 34 uses black toner particles while developer unit 36 uses red toner particles. Inasmuch as the developer units are identical, only developer unit 34 will be described hereinafter in greater detail with reference to FIGS. 2 through 4, inclusive.

With continued reference to FIG. 1, after the electrostatic latent image is developed, belt 10 advances the toner powder image to transfer station D. A sheet 42 is advanced to transfer station D by a sheet feeding apparatus. Preferably, the sheet feeding apparatus includes a feed roll contacting the uppermost sheet of the stack of sheets. The feed roll rotates to advance the uppermost sheet from the stack into a chute. The chute directs the advancing sheet into contact with photoconductive surface 12 of belt 10 in a timed sequence so that the toner powder image formed thereon contacts the advancing sheet at transfer station D. Transfer station D includes an electrically biased transfer roll which has sheet grippers to releasably secure sheet 42 thereto. Sheet 42 moves in a recirculating path on the surface of roll 44. Roll 44 is electrically biased to a voltage having a suitable magnitude and polarity sufficient to attract the toner powder image from photoconductive surface 12 to sheet 42. Thus, as the sheet passes through the nip defined by belt 10 and roller 44, the first toner powder image, i.e. the black toner powder image, is transferred from photoconductive surface 12 to sheet 42. Sheet 42 remains adhering to the surface of roller 44 for another cycle. Once again, the sheet passes through the nip defined by belt 10 and roller 44. As the sheet passes through the nip, the second toner powder image, i.e. the red toner powder image, is transferred thereto. Thus, a black toner powder image and a red toner powder image are transferred to sheet 42 forming a color highlighted copy. After transfer, sheet 42 is released from roll 44 and advances to fusing station E.

Fusing station E includes a fuser assembly, indicated generally by the reference numeral 46, which permanently affixes the transferred powder images to sheet 42. Preferably, fuser assembly 46 comprises a heated fuser roller 48 and back-up roller 50. Sheet 42 passes between fuser roller 48 and back-up roller 50 with the toner powder images contacting fuser roller 48. In this manner, the toner powder images are permanently affixed to sheet 42. After fusing, sheet 42 is advanced to a catch tray for subsequent removal from the printing machine by the operator.

After the sheet of support material is separated from photoconductive surface 12 of belt 10, the residual toner particles adhering to photoconductive surface 12 are removed therefrom at cleaning station F. Cleaning station F includes a rotatably mounted fibrous brush 52 in contact with photoconductive surface 12. The particles are cleaned from photoconductive surface 12 by the rotation of brush 52 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer units of the present invention therein.

Figure 2:
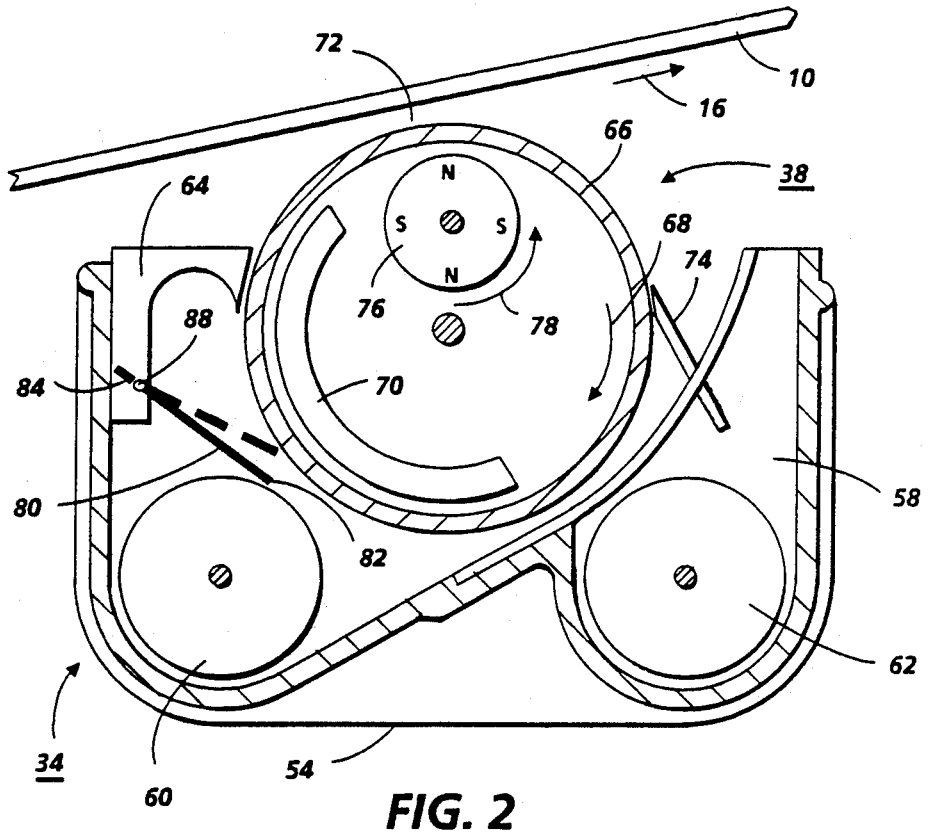
FIG. 2 is an elevational view showing one embodiment of the developer units used in the FIG. 1 printing machine.

Referring now to the specific subject matter of the present invention, FIG. 2, shows one embodiment of developer unit 34 in greater detail. Developer unit 34 includes a housing 54 defining chambers 56 and 58 for storing a supply of developer material therein. Augers 60 and 62 mix the developer material in chambers 56 and 58 of housing 54 and advance the developer material to developer roller 38. Developer roller 38 advances the black developer material into contact with the first electrostatic latent image recorded on the photoconductive surface of belt 10. A trim bar 64 regulates the thickness of the developer pile height on developer roller 38. Developer roller 38 includes a non-magnetic tubular member 66 preferably made from aluminum having the exterior surface thereof roughened. Tubular member 66 rotates in the direction of arrow 68. An arcuate magnet 70 is mounted interiorly of tubular member 66 and spaced therefrom. Magnet 70 is stationary and positioned to attract the developer material to the exterior circumferential surface of tubular member 66 before development zone 72. In this way, as tubular member 66 rotates in the direction of arrow 68, developer material is attracted to the exterior circumferential surface thereof before entering development zone 72. Preferably, magnet 70 extends through an arc of about 180°. After the developer material exits development zone 72, it is capable of falling freely from tubular member 66 inasmuch as there is little or no magnetic forces attracting the developer material thereto. Blade 74 may scrape unused developer material from tubular member 66 returning it to chamber 58 of housing 54 for remixing with the developer material remaining therein. A cylindrical magnet 76 is positioned interiorly of tubular member 66 opposed from development zone 72. Magnet 76 rotates in the direction of arrow 78. In this way, the developer material on tubular member 66 passing through development zone 72 is highly agitated. By way of example, both magnets 76 and 70 are made from barium ferrite having magnetic poles impressed on the surfaces thereof. Preferably magnet 76 rotates at a significantly high angular velocity than tubular member 66, i.e. three or four times greater. The diameter of magnet 76 is less than the radius of tubular member 66. Tubular member 66 is electrically biased by a voltage source (not shown) to a suitable polarity and magnitude. The voltage level is intermediate that of the background voltage level and the image voltage level recorded on the photoconductive surface of belt 10. Further details of this type of developer unit may be found in U.S. Pat. No. 4,614,420 issued to Lubinsky et al. in 1986, the relevant portions thereof being hereby incorporated into the present application. After the first electrostatic latent image has been developed, developer unit 34 becomes non-operative and developer unit 36 becomes operative. A developer unit becomes non-operative when tubular member 66 no longer transports developer material into contact with the photoconductive surface of belt 10. This is achieved by pivoting blade member 80 from the non-operative position, shown by a solid line, to the operative position, shown by a dotted line. In the non-operative position the free end portion 82 of blade member 80 is spaced from tubular member 66. End portion 84 of blade member 80 is mounted pivotably on the support for trim blade 64. Thus, when blade member 80 is positioned in the operative position, free end portion 82 presses against tubular member 66 preventing the developer material on the surface thereof from being transported to development zone 72. Thus, when developer unit 34 is non-operative, blade member 80 is in the operative position so that the free end portion 82 thereof prevents developer material on tubular member 66 from being transported to development zone 72. Blade member 80 pivots from the non-operative position to the operative position during the time that the interimage region on the photoconductive surface of belt 10 passes through development zone 72. Thus, during this time, developer unit 34 is switched to the off mode and developer unit 36 is switched to the on mode. When the free end portion 82 of blade member 80 is pressed against tubular member 66 no developer material is allowed beyond that point. Conversely, when blade member 80 is pivoted to the non-operative position, the free end portion thereof is spaced from tubular member 66 and developer material flow resumes substantially instantaneously. Preferably, blade-member 80 is made from steel having a thickness of at least 0.005 centimeters with a Nickel saturated with Teflon, polytetrafluorethylene, coating of about 0.001 centimeters thick plated thereon. The coating is hardened to a Rockwell C hardness of between 68 and 72. Blade member 80 extends across the width of tubular member 66. Alternatively, blade member 80 can be made from phosphor bronze, beryllium copper or any other suitable material plated for wear resistance and low friction. By way of example, the free end of blade 80 contacts tubular member 66 at an angle of between 10° and 20° relative to the tangent to the tubular member. The pressure being applied by the blade member along the contact line is at least 10 grams/centimeter. The exact value of the contact angle and the pressure is dependent upon the characteristics of the developer material, i.e. its flowability, magnetic forces, roughness of the surface of tubular member 66, and the friction at contact. When blade member 80 is in the non-operative position, the free end portion thereof is spaced from the surface of tubular member 66 a distance of about 5 millimeters.

Figure 3:
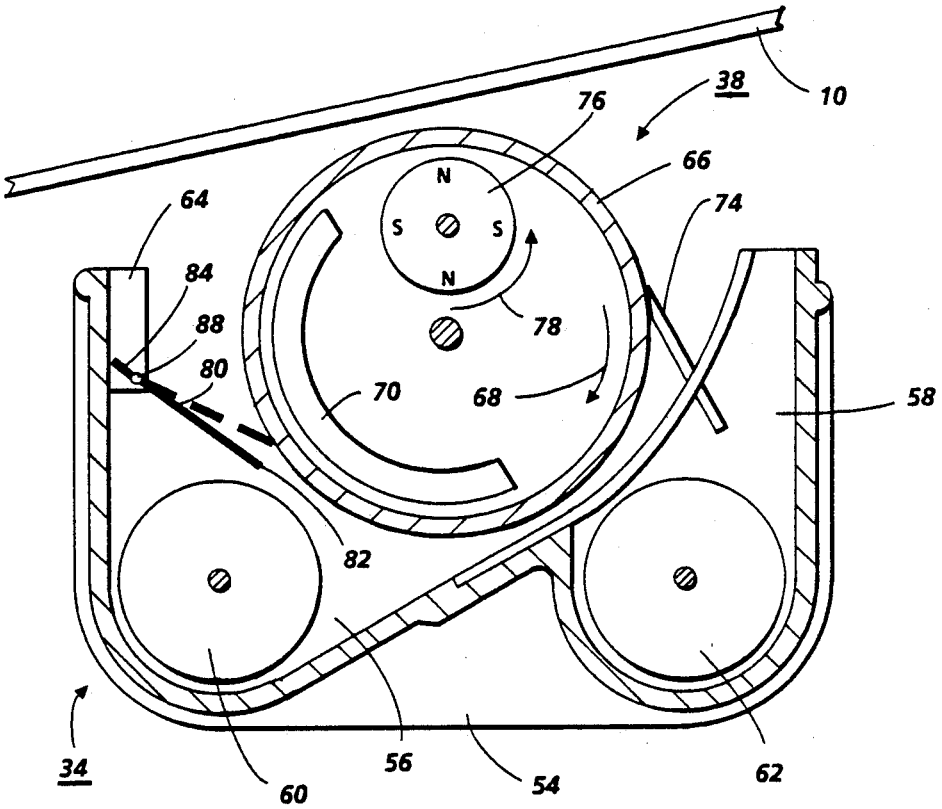
FIG. 3 is an elevational view showing another embodiment of one of the developer units used in the FIG. 1 printing machine.

Turning now to FIG. 3, there is shown another embodiment of developer unit 34. The embodiment shown in FIG. 3 is identical to that of FIG. 2 with the exception that the FIG. 3 embodiment does not employ a trim blade 64. As shown in FIG. 3, blade member 80 is mounted pivotably at end 84 on support 86 secured to housing 54. In the operative position, as shown by the dashed line, free end portion 82 presses against tubular member 66. In the non-operative position, as shown by the solid line, the free end portion 82 of blade member 80 is spaced from tubular member 66 the appropriate distance to regulate the thickness of the developer material pile height on tubular member 66. Thus, blade member 80 performs a dual function, in the operative position, it prevents developer material from being advanced on tubular member 66 to the development zone, and, in the non-operative position, it regulates the thickness of the pile height of the developer material being advanced on tubular member 66 to the development zone.

Figure 4:
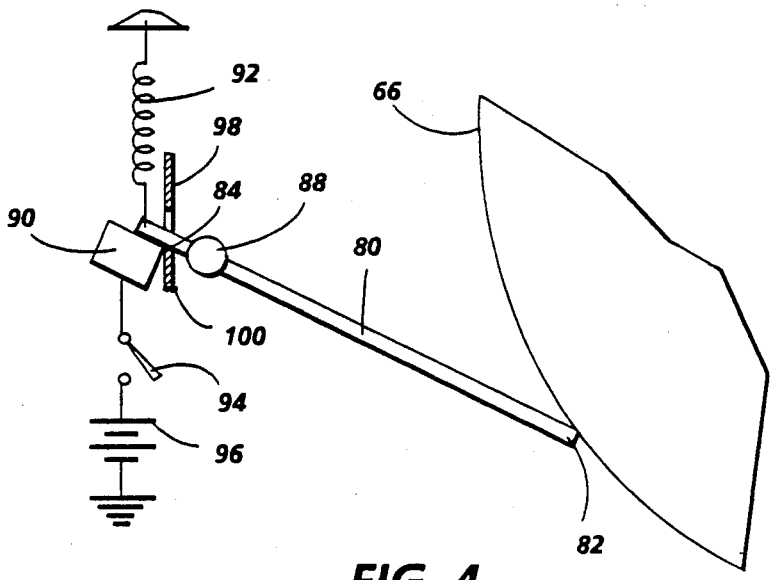
FIG. 4 is a fragmentary elevational view depicting the apparatus for moving the blade used in the FIG. 2 and FIG. 3 developer units between the operative and non-operative positions.

Referring now to FIG. 4, there is shown the arrangement for pivoting blade member 80. As depicted thereat, blade member 80 is mounted pivotably at point 88. End 84 of blade 80 is positioned adjacent electromagnet 90. A spring 92 is secured to end 84. Switch 94 connects electromagnet 90 to voltage source 96. When switch 94 is opened, electromagnet 90 is deenergized and spring 92 pivots blade member 80 to the non-operative position defined by having end 84 abut against stop 98. When end 84 abuts against stop 98, free end portion 82 of blade member 80 is spaced the required distance from tubular member 66. Alternatively, when switch 94 is closed, electromagnet 90 is connected to voltage source 96. This energizes electromagnet 90 causing it to attract end 84 of blade member 80 thereto. Thus, when electromagnet 90 is energized, blade 80 pivots until end 84 engages stop 100. When end 84 engages stop 100, the free end portion 82 of blade member 84 presses against tubular member 66 terminating development.

In recapitulation, the developer unit of the present invention employs a pivotably mounted blade to regulate development. In the operative position, the free end of the blade presses against the developer roller preventing developer material from being transported thereon into the development zone. When pivoted to the non-operative position, the free end portion of the blade is spaced from the tubular member permitting developer material to be transported thereon to the development zone. In the non-operative position, the blade member may also be used to regulate the thickness of the developer material being transported into the development zone. Developer units of this type may be employed in a color highlight printing machine where it is necessary to switch developer units rapidly to enable successive electrostatic latent images to be developed with different color developer materials.

It is, therefore, apparent that there has been provided in accordance with the present invention, a developer unit for use in an electrophotographic printing machine that fully satisfies the aims and advantages hereinbefore set forth. While this invention has been described in conjunction with various embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a member with developer material, including:

means, positioned closely adjacent the member defining a development zone therebetween, for transporting the developer material into contact with the member in the development zone so as to develop the latent image recorded thereon with developer material; and a blade member arranged to move from an operative position to a non-operative position, said blade member, in the operative position, having the free end portion thereof contacting said transporting means to prevent said transporting means from transporting developer material into contact with the member preventing development of the latent image recorded thereon, and said blade member, in the non-operative position, having the free end portion thereof spaced from said transporting means to enable said transporting means to transport the developer material into contact with the member to develop the latent image recorded thereon, said blade member, in the non-operative position, having the free end portion thereof spaced from said transporting means a preselected distance to control the quantity of developer material being advanced by said transporting means to the development zone.

2. An apparatus according to claim 1, further including means for moving said blade member between the operative position and non-operative position.

3. An apparatus according to claim 2, wherein said moving means includes an electromagnet.

4. An apparatus according to claim 2, wherein said blade member is mounted pivotably.

5. An apparatus for developing a latent image recorded on a member with developer material, including:

means, positioned closely adjacent the member defining a development zone therebetween, for transporting the developer material into contact with the member in the development zone so as to develop the latent image recorded thereon with developer material; and a pivotably mounted blade member arranged to move from an operative position to a non-operative position, said blade member, in the operative position, having the free end portion thereof contacting said transporting means to prevent said transporting means from transporting developer material into contact with the member preventing development of the latent image recorded thereon, and said blade member, in the non-operative position, having the free end portion thereof spaced from said transporting means to enable said transporting means to transport the developer material into contact with the member to develop the latent image recorded thereon, said blade member being positioned before the development zone in the direction of movement of the developer material, said blade member, in the non-operative position, having the free end portion thereof spaced from said transporting means a preselected distance to control the quantity of developer material being advanced by said transporting means to the development zone;

means for moving said blade member between the operative position and non-operative position.

6. An apparatus according to claim 5, wherein said blade member is preferably made from steel having nickel saturated with polytetrafluorethylene plated thereon.

7. An electrophotographic printing machine of the type in which at least a first latent image and a second latent image recorded on a photoconductive member are developed with different color developer materials, wherein the improvement includes:

first means, positioned closely adjacent the photoconductive member defining a first development zone therebetween, for transporting developer material of a first color into contact with the photoconductive member in the first development zone so as to develop the first latent image recorded thereon with the first color developer material;

second means, positioned closely adjacent the photoconductive member defining a second development zone therebetween, for transporting developer material of a second color into contact with the photoconductive member in the second development zone so as to develop the second latent image recorded thereon with the second color developer material;

a first blade member operatively associated with said first transporting means and being arranged to move from an operative position to a non-operative position, said first blade member, in the operative position, having the free end portion thereof contacting said first transporting means, and, in the non-operative position having the free end portion thereof spaced from said first transporting means, said first blade member, in the non-operative position, having the free end thereof spaced from said first transporting means a preselected distance to control the quantity of first color developer material being advanced by said first transporting means to the first development zone; and a second blade member operatively associated with said second transporting means and being arranged to move from an operative position to a non-operative position, said second blade member, in the operative position, having the free end portion thereof contacting said second transporting means, and, in the non-operative position having the free end portion thereof spaced from said second transporting means, said second blade member, in the non-operative position, having the free end thereof spaced from said second transporting means a preselected distance to control the quantity of second color developer material being advanced by said second transporting means to the second development zone, wherein said first blade is in the non-operative position when said second blade member is in the operative position to prevent said second transporting means from transporting second color developer material into contact with the photoconductive member while enabling said first transporting means to transport the first color developer material into contact with the photoconductive member to develop the first latent image recorded thereon with first color developer material, and said second blade member being in the non-operative position when said first blade member is in the operative position to prevent said first transporting means from transporting first color developer material into contact with the photoconductive member while enabling said second transporting means to transport the second color developer material into contact with the photoconductive member to develop the second latent image recorded thereon with second color developer material.

8. A printing machine according to claim 7, further including:

first means for moving said first blade member between the operative position and non-operative position; and second means for moving said second blade member between the operative position and non-operative position.

9. A printing machine according to claim 8, wherein:

said first moving means includes a first electromagnet; and said second moving means includes a second electromagnet.

10. A printing machine according to claim 8, wherein:

said first blade member is mounted pivotably; and said second blade member is mounted pivotably.

11. An electrophotographic printing machine of the type in which at least a first latent image and a second latent image recorded on a photoconductive member are developed with different color developer materials, wherein the improvement includes:

first means, positioned closely adjacent the photoconductive member defining a first development zone therebetween, for transporting developer material of a first color into contact with the photoconductive member in the first development zone so as to develop the first latent image recorded thereon with the first color developer material;

second means, positioned closely adjacent the photoconductive member defining a second development zone therebetween, for transporting developer material of a second color into contact with the photoconductive member in the second development zone so as to develop the second latent image recorded thereon with the second color developer material;

a first pivotably mounted blade member operatively associated with said first transporting means and being arranged to move from an operative position to a non-operative position, said first blade member, in the operative position, having the free end portion thereof contacting said first transporting means, and, in the non-operative position having the free end portion thereof spaced from said first transporting means, said first blade member being positioned before the first development zone in the direction of movement of the first color developer material, said first blade member, in the non-operative position, having the free end thereof spaced from said first transporting means a preselected distance to control the quantity of first color developer material being advanced by said first transporting means to the first development zone;

a second pivotably mounted blade member operatively associated with said second transporting means and being arranged to move from an operative position to a non-operative position, said second blade member, in the operative position, having the free end portion thereof contacting said second transporting means, and, in the non-operative position having the free end portion thereof spaced from said second transporting means, said second blade member being positioned before the second development zone in the direction of movement of the second color developer material, said second blade member, in the non-operative position, having the free end thereof spaced from said second trasnporting means a preselected distance to control the quantity of second color developer material being advanced by said second transporting means to the second development zone wherein said first blade is in the non-operative position when said second blade member is in the operative position to prevent said second transporting means from transporting second color developer material into contact with the photoconductive member while enabling said first transporting means to transport the first color developer material into contact with the photoconductive member to develop the first latent image recorded thereon with first color developer material, and said second blade member being in the non-operative position when said first blade member is in the operative position to prevent said first transporting means from transporting first color developer material into contact with the photoconductive member while enabling said second transporting means to transport the second color developer material into contact with the photoconductive member to develop the second latent image recorded thereon with second color developer material;

first means for moving said first blade member between the operative position and non-operative position; and second means for moving said second blade member between the operative position and non-operative position.

12. A printing machine according to claim 11, wherein:

said first blade member is preferably made from steel having nickel saturated with polytetrafluorethylene plated thereon; and said second blade member is preferably made from steel having nickel saturated with polytetrafluorethylene plated thereon.

* * * * *